US009192845B2

(12) United States Patent
Ho et al.

(10) Patent No.: US 9,192,845 B2
(45) Date of Patent: Nov. 24, 2015

(54) MOUTH GUARD RETAINER

(71) Applicants: James Y. S. Ho, Berkeley, CA (US); Eric Yabu, Oakland, CA (US)

(72) Inventors: James Y. S. Ho, Berkeley, CA (US); Eric Yabu, Oakland, CA (US)

( * ) Notice: Subject to any disclaimer, the term of this patent is extended or adjusted under 35 U.S.C. 154(b) by 287 days.

(21) Appl. No.: 13/663,222

(22) Filed: Oct. 29, 2012

(65) Prior Publication Data

US 2014/0116449 A1 May 1, 2014

(51) Int. Cl.

| | |
|---|---|
| ***A63B 71/08*** | (2006.01) |
| ***A42B 3/04*** | (2006.01) |
| *A63B 71/10* | (2006.01) |

(52) U.S. Cl.

CPC ..... *A63B 71/085* (2013.01); *A42B 3/04* (2013.01); *A63B 71/10* (2013.01); *A63B 2071/088* (2013.01)

(58) Field of Classification Search

USPC ..... 128/859–862, 848; 433/2, 8, 6–7, 18, 433/24; 602/902; 2/9, 424–425

See application file for complete search history.

(56) References Cited

U.S. PATENT DOCUMENTS

| | | | | |
|---|---|---|---|---|
| 4,837,866 | A * | 6/1989 | Rector et al. | 2/424 |
| 5,095,552 | A * | 3/1992 | Parkinson | 2/424 |

* cited by examiner

*Primary Examiner* — Ophelia A Hawthorne
(74) *Attorney, Agent, or Firm* — Francis Law Group

(57) ABSTRACT

A resilient mouth guard retention apparatus for securing a mouth guard to an exterior surface of a helmet during temporary periods of non-use without permanently deforming said mouth guard. The retention apparatus is configured to provide a mouth guard retention space between the retention apparatus and helmet when the retention member is attached to the helmet and stretched in a first direction away from the helmet and apply an engagement force to a mouth guard when disposed in the mouth guard retention space.

1 Claim, 9 Drawing Sheets

MOUTH GUARD RETAINER

FIELD OF THE INVENTION

The present invention relates to athletic mouth guards. More particularly, the present invention relates to apparatus, systems and methods for securing mouth guards to an athlete's helmet that maintains the integrity of the mouth guard.

BACKGROUND OF THE INVENTION

The Center for Disease Control and Prevention (CDC) estimates that more than 3.8 million concussions and sports-related mild traumatic brain injuries ("MTBI") occur each year. Concussions, and in many instances, mild traumatic brain injuries, particularly when repeated multiple times, significantly threaten the long-term health of an athlete. The health care costs associated with sports-related traumatic brain injuries are estimated to be in the hundreds of millions of dollars annually.

As is well known in the art, a concussion is an alteration of consciousness, disturbance in vision and equilibrium caused by a direct blow to the head, rapid acceleration and/or deceleration of the head, or direct blow to the base of the skull from a vertical impact to the chin. Concussions result in complications including severe headaches, dizziness, earaches, facial pain, ringing in the ears, nausea, irritability, confusion, disorientation, dizziness, amnesia, concentration difficulty, blurred vision, sleep disturbance, increased size of one pupil, severe weakness in an arm or leg, photophobia, vertigo, impaired speech and permanent brain damage.

A MTBI is also a traumatically induced alteration in brain function that is manifested by an alteration of awareness or consciousness, including, but not limited to, loss of consciousness, "ding," sensation of being dazed or stunned, sensation of "wooziness" or "fogginess," seizure, or amnesic period; and signs and symptoms commonly associated with post-concussion syndrome.

The CDC estimates that approximately one-third, i.e. 1.2 million, of the concussions and mild traumatic brain injuries (hereinafter "sports-related traumatic brain injuries"), which are "diagnosed" annually, occur playing football. Approximately 63,000 of the sports-related traumatic brain injuries occur annually among high school varsity athletes, with football accounting for about 63% of the cases. Sports-related traumatic brain injuries in hockey affect 10% of the athletes and make up 12%-14% of all injuries.

For example, a typical range of 4-6 sports-related traumatic brain injuries per year in a football team of 90 players (7%), and 6 per year from a hockey team with 28 players (21%) is not uncommon. In rugby, a sports-related traumatic brain injury can affect as many as 40% of players on a team each year.

As indicated, nearly 1.2 million sports-related traumatic brain injuries that are diagnosed annually occur playing football. Since many sports-related traumatic brain injuries go undetected, it is, however, believed that over 2 million football players suffer at least one sports-related traumatic brain injury each season.

Undetected sports-related traumatic brain injuries result from several factors. First, many athletes, particularly, professional athletes, often attempt to "shake it off" when they are hurt to maintain their playing status.

Second, over one-half (½) of high school football teams do not have access to a certified athletic trainer to assess on-field head injuries and/or determine when a player is attempting to mask symptoms of a sports-related traumatic brain injury.

Third, coaches and athletic trainers often do not have access to appropriate tools to monitor, track and/or quantify potentially harmful impacts.

As a result, it is estimated that nearly 80% of sports-related traumatic brain injuries that occur playing football go undetected.

It is also estimated that one-half (½) or more of the sports-related traumatic brain injuries are the result of blows proximate the lower jaw. Indeed, the CDC estimates that approximately 75% of the sports-related traumatic brain injuries that occur while playing football are the result of the lower jaw relaying the shock of impact to the brain.

Considerable research has thus been directed to developing means for dissipating the impact forces applied to the jaw. In 1964, seminal research by Stenger, et. al. indicated that forces from temporomandibular impact could be attenuated with a mouth guard (see Stenger, et al., *Mouth guards: Protection Against Shock to the Head, Neck and Teeth*, J. Am Dent Assoc, vol. 69, pp. 273-81 (1964)).

Various mouth guard designs have thus been developed to dissipate impact forces and/or shocks to the jaw. Illustrative are the custom mouth guards disclosed in U.S. Pat. Nos. 5,931,164, 3,532,091, 4,672,959, and 5,339,832.

U.S. Pat. No. 5,931,164 (Kiely, et al.) discloses an athletic mouth guard including a U-shaped base portion, an upwardly projecting inner flange portion joined to an inner edge of the base portion and an upwardly projecting outer flange portion joined to an outer edge of the base portion. The Kiely, et al. mouth guard is molded from a composition including a light pervious foundation material and a light reflective aggregate distributed throughout the foundation material.

U.S. Pat. No. 3,532,091 (Lerman) discloses a mouth guard that includes a relatively large closed passage-providing portion containing a fluid, either a liquid or a gas. The passage-providing portion is disposed either adjacent the labial surface of the teeth, between the occlusal surfaces of the upper and lower teeth, or in both positions. The closed fluid passage hydrostatically distributes forces exerted at one point thereon over a much greater area, thereby decreasing the detrimental effect of the blow.

U.S. Pat. No. 4,672,959 (May, et al.) discloses a mouth guard that includes a lens-like brace integrally formed in the outer upstanding portion of the elongated shell and positioned on the outer surface of the anterior teeth. The May mouthpiece further includes a thickened connecting portion overlying the biting surface of the posterior teeth to help prevent concussion and to lessen the shock to the tempro mandibular joint in the event of a blow to either the jaw or head.

Indentations are also formed in the thickened connecting portion opposite to the biting surfaces of the user's upper teeth. The indentations have a size and shape complementary to and for receiving the user's lower teeth to form an occlusal index for positioning the user's lower teeth, helping to eliminate the trauma of a blow to the side of the jaw.

U.S. Pat. No. 5,339,832 (Kittelsen, et al.) discloses a composite mouth guard having a tough, softenable thermoplastic mouth guard portion with a U-shaped base having upwardly extending inner lingual and outer labial walls. A shock absorbing and attenuating non-softening, resilient, low compression, elastomer framework is embedded in the mouth guard portion to absorb, attenuate and dissipate shock forces exerted on the mouth guard.

The Kittelsen, et al. framework also includes posterior cushion pads within the posterior portions of a U-shaped base with enlarged portions in the bicuspid and molar regions of the teeth to fit on the bicuspid teeth adjacent the canine teeth and in the area of the first adult molars, respectively. The cushion pads and enlarged portions, inter alia, prohibit the user from biting too deeply into the soft thermoplastic ethylene vinyl acetate (EVA) of the mouth guard portion and to ensure that there is no excessive upward displacement of the anterior portions of the lower mandible.

A transition support portion extends forwardly from the posterior cushion pads and connects to an anterior impact brace. The anterior impact brace has rearwardly protruding anterior cushion pads extending through the upward outer labial wall and contact the anterior teeth of the upper jaw to attenuate and dissipate shock exerted thereto.

The noted mouth guards are not your typical "boil and bite" guards and, hence, can, and in many instances will, cost in the range of $200-$500.

More recently, sensored mouth guards have also been developed to monitor impact forces and accelerations resulting from blows proximate the jaw. The sensored mouth guards are also quite expensive; typically costing in the range of $1500-$2500.

Although the incidences of sports-related traumatic brain injuries can be substantially reduced by using a mouth guard, the ability of a mouth guard to do so is primarily dependent upon the mouth guard properly aligning the jaw of the athlete. Similarly, sensored mouth guards must also be properly aligned to accurately monitor impact forces and accelerations.

Since many of the available mouth guards, including the aforementioned mouth guards, do not include tethers or other fastening means to retain (or store) the mouth guard, many athletes wedge the mouth guard snugly between the bars of the facemask or simply hold the mouth guard with their teeth. Such actions can, and in many instances will, deform the mouth guard, resulting in misalignment of the mouth guard and, hence, jaw when re-inserted in the mouth.

It would thus be desirable to provide apparatus, systems and methods for safely securing mouth guards to a variety of helmets that maintains the integrity of the mouth guard.

It is therefore an object of the present invention to provide mouth guard retention means and associated methods for securing mouth guards during non-use to a variety of helmets that maintain the integrity of the mouth guards.

It is another object of the present invention to provide mouth guard retention means and associated methods that facilitate quick and easy placement, retention and removal of mouth guards.

SUMMARY OF THE INVENTION

The present invention is directed to mouth guard retention apparatus, systems and methods for securing mouth guards (during non-use) to an athlete's helmet that maintains the integrity of the mouth guard. In a preferred embodiment of the invention, the mouth guard retention apparatus comprise an elastic retention member that is configured to be attached to a helmet and exert a predetermined engagement force to a mouth guard (when retained thereby) that securely retains the mouth guard against the helmet without deforming the mouth guard.

In a preferred embodiment of the invention, the maximum engagement force provided by the retention apparatus of the invention is less than approximately 1.0 lbs.

In some embodiments, the engagement force is preferably less than approximately 0.5 lbs.

In some embodiments, the engagement force is preferably in the range of approximately 0.25-0.5 lbs.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE PREFERRED EMBODIMENT

Figure 1:
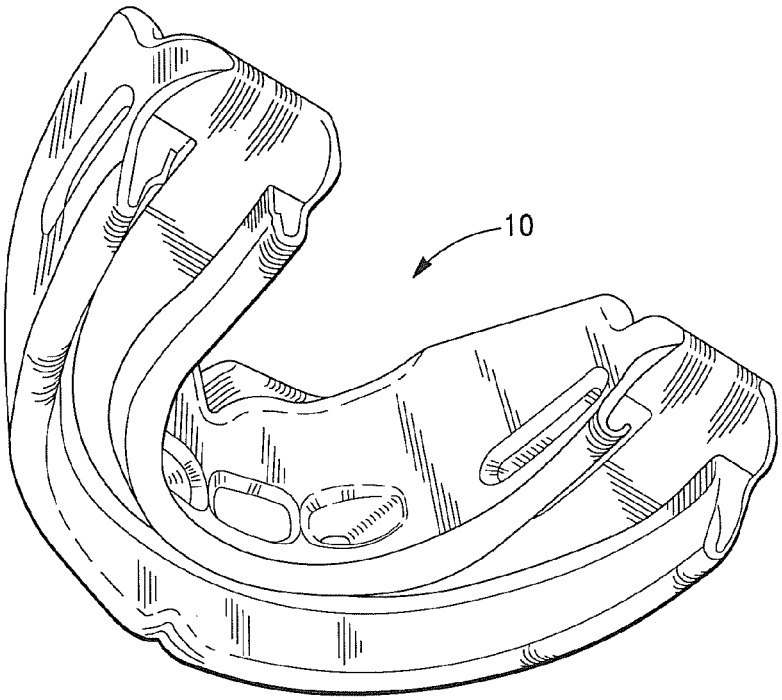
FIG. 1 (PRIOR ART)
FIGS. 1 and 2 are perspective views of a prior art mouth guard.

Before describing the present invention in detail, it is to be understood that this invention is not limited to particularly exemplified apparatus, systems, structures or methods as such may, of course, vary. Thus, although a number of apparatus, systems and methods similar or equivalent to those described herein can be used in the practice of the present invention, the preferred apparatus, systems, structures and methods are described herein.

It is also to be understood that, although the mouth guard retention structures and systems of the invention are illustrated and described in connection with a conventional football helmet, the mouth guard retention structures and systems of the invention are not limited to a football helmet. According to the invention, the mouth guard retention structures and systems of the invention can be employed on any helmet, including, without limitation, a hockey helmet, skateboard helmet, auto racing helmet, etc.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise.

DEFINITIONS

The terms "elastic" and "resilient" are used interchangeably herein, and mean and include a material that is capable of elongation of at least 20% in one direction without tearing.

The terms "engagement force" and "recovery force" are used interchangeably herein, and mean the force(s) applied to a mouth guard disposed between a mouth guard retention apparatus and a surface of a helmet when the apparatus is operatively engaged to the helmet.

The following disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

As indicated above, the present disclosure is directed to mouth guard retention apparatus, systems and methods for securing (or storing) mouth guards to an athlete's helmet during non-use that maintains the integrity of the mouth guard. In a preferred embodiment of the invention, the mouth guard retention apparatus include an elastic retention member that is configured to be attached to a helmet and exert a predetermined engagement force to a mouth guard (when retained thereby) that securely retains the mouth guard against the helmet without deforming the mouth guard.

As indicated above, although the incidences of sports-related traumatic brain injuries can be substantially reduced by using a mouth guard, the ability of a mouth guard to do so is primarily dependent upon the mouth guard properly aligning the jaw of the athlete. Similarly, censored mouth guards must also be properly aligned to accurately monitor impact forces and accelerations.

Figure 2:
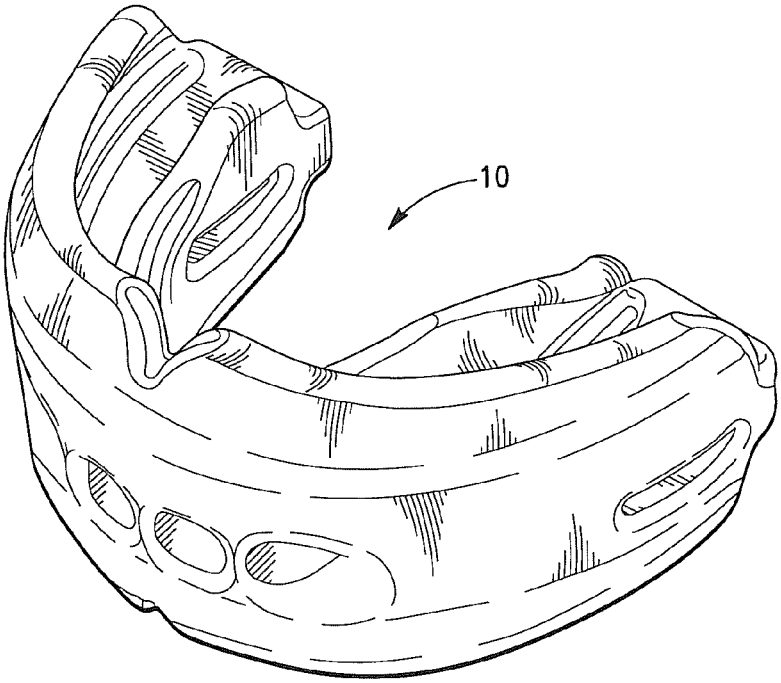
FIG. 2 (PRIOR ART)

As also indicated above, use of a mouth guard will, in most instances, dissipate impact forces applied or exerted proximate the jaw and reduce the incidences of concussions and mild traumatic brain injuries resulting therefrom. Illustrative is the mouth guard 10 shown in FIGS. 1 and 2.

Figure 3:
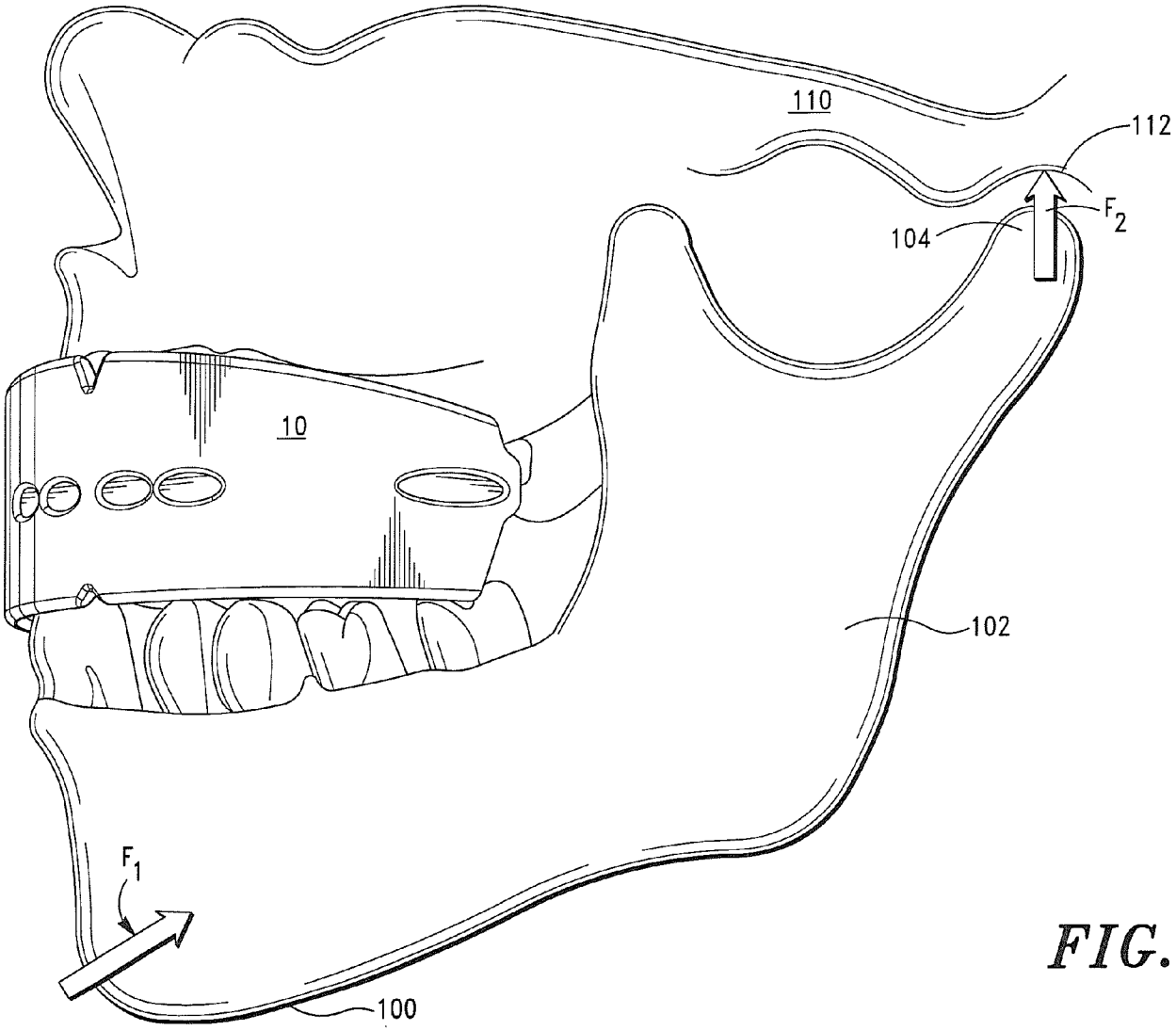
FIG. 3 is an illustration of a human skull and jaw showing the distribution of a force applied to the jaw.

Referring now to FIG. 3, when the jaw 100 is subjected to an impact or blow (denoted by arrow $F_1$), the force(s) resulting therefrom force the mandible 102 upward. The force(s) are then transferred from the end of the mandible, i.e. condyle 104, to the base of the skull 110, i.e. skull socket 112 (denoted by arrow $F_2$).

When the jaw 100 is subjected to a significant impact; particularly, without the use of a mouth guard, the condyle 104 can, and in most instances will, strike the base of the skull 110 with sufficient force to cause a traumatic brain injury. However, as stated, a properly aligned mouth guard, such as shown in FIG. 3, can and will, in most instances, dissipate the impact force and prevent a traumatic brain injury.

Figure 4:
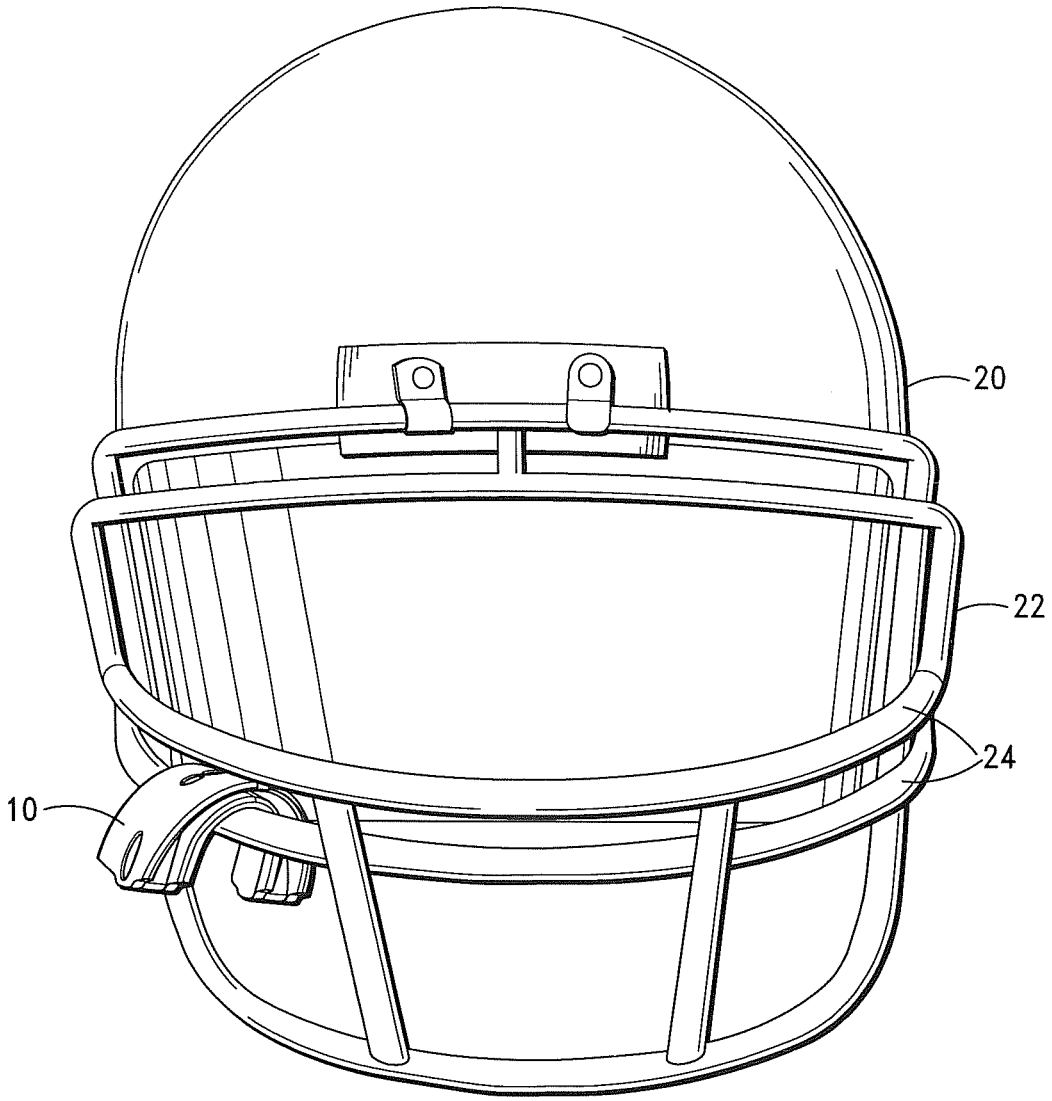
FIG. 4 is a front plan view of a football helmet with a mouth guard wedged between bars of the facemask.

As also indicated above, many of the available mouth guards, such as mouth guard 10, do not include tethers or other fastening means to retain (or store) the mouth guard when not in use. As a result, many athletes using a helmet 20 wedge the mouth guard 10 snugly between the bars 24 of the facemask 22 during non-use, as shown in FIG. 4

Some athletes simply hold and often times chew the mouth guard 10 with their teeth.

Such actions can, and in many instances will, deform the mouth guard 10, resulting in misalignment of the mouth guard 10 and, hence, jaw when re-inserted in the mouth.

Figure 5:
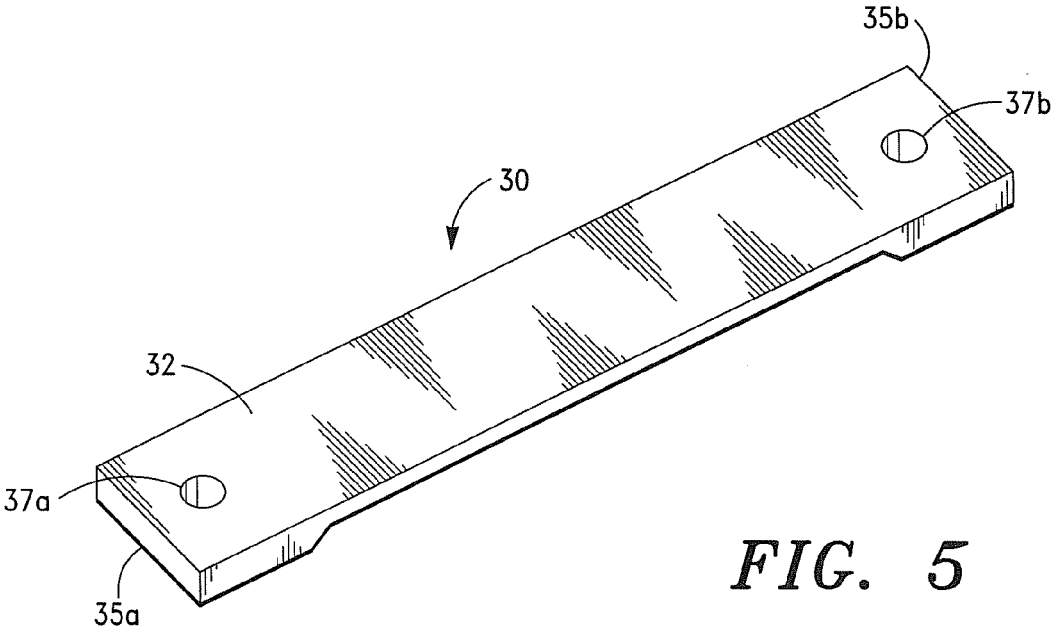
FIG. 5 is a perspective view of one embodiment of a mouth guard retention apparatus, in accordance with the invention.
Figure 6:
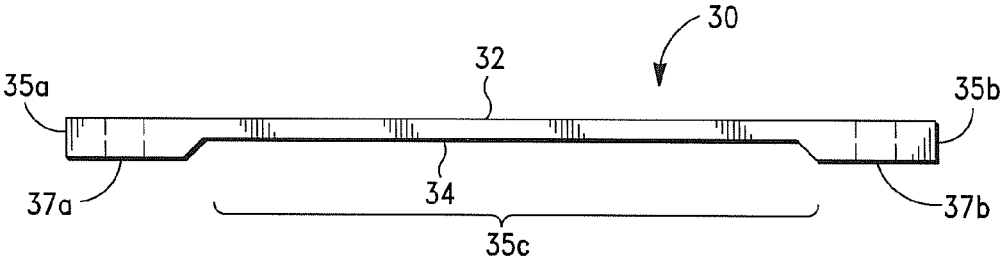
FIG. 6 is a side plan view of the mouth guard retention apparatus shown in FIG. 5, in accordance with the invention.

Referring now to FIGS. 5-6, there is shown one embodiment of a mouth guard retention apparatus of the invention. As illustrated in FIG. 5, the retention apparatus 30 has a generally elongated, rectangular shape having top 32 and bottom 34 surfaces.

Figure 12:
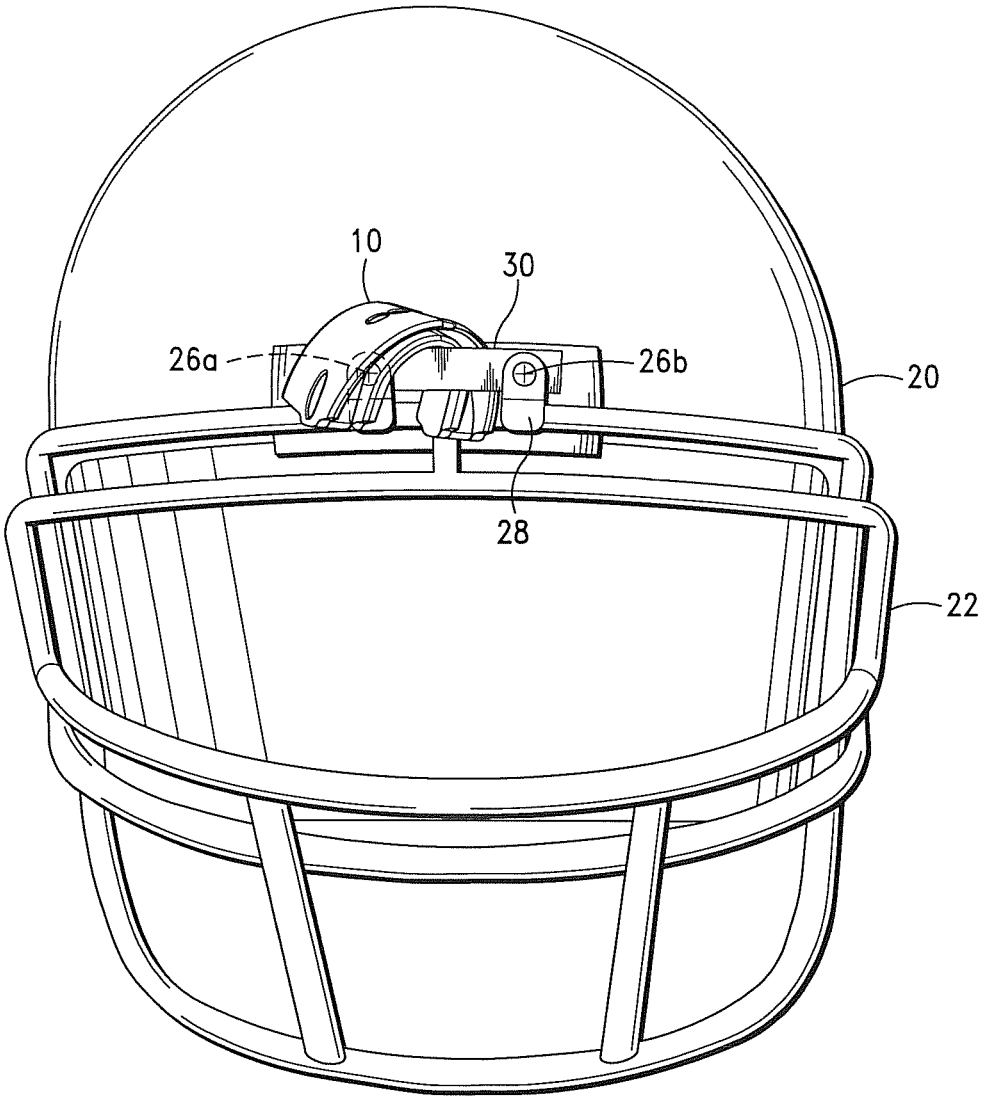
FIG. 12 is a front plan view of a football helmet with one embodiment of a mouth guard retention apparatus engaged on a front surface of the helmet, in accordance with the invention.
Figure 13:
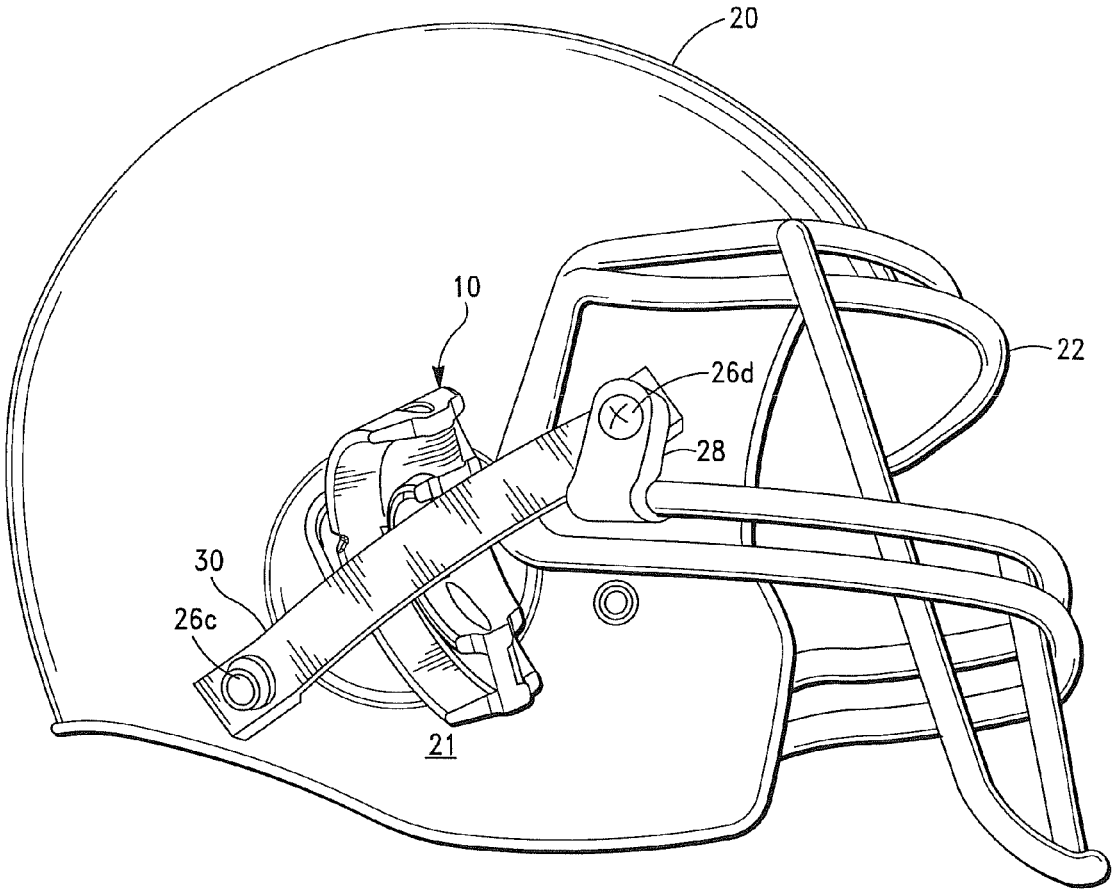
FIGS. 13 and 14 are side plan views a football helmet with the mouth guard retention apparatus shown in FIG. 12 engaged to the side of the helmet, in accordance with the invention.

Disposed proximate each end 35*a*, 35*b* of the retention apparatus 30 are lumens 37*a*, 37*b* that are adapted to receive engagement screws therein to connect the apparatus 30 to a helmet (see FIGS. 12 and 13). Thus, in some embodiments of the invention, the retention apparatus lumens 37*a*, 37*b* are spaced a distance equal to the distance between pre-existing helmet facemask holes or screws, whereby the retention apparatus 30 can be attached at pre-existing helmet facemask holes, and, preferably with pre-existing helmet screws.

In a preferred embodiment of the invention, the retention apparatus 30 comprises a resilient of elastic elongated member. According to the invention, the retention apparatus 30 can thus comprise various resilient materials, including, without limitation, natural rubber and stretch VINYL™ (polyvinyl chloride). In a preferred embodiment, the retention apparatus 30 comprises natural rubber.

In some embodiments of the invention, the natural rubber is impregnated or coated with a UV stabilizer to reduce environmental degradation of the rubber.

As indicated, in a preferred embodiment, when a retention apparatus of the invention (or a retention member thereof) is secured on both ends, i.e. engaged to a helmet, the retention apparatus provides a predetermined, controlled engagement force to a mouth guard when secured thereby.

Figure 7:
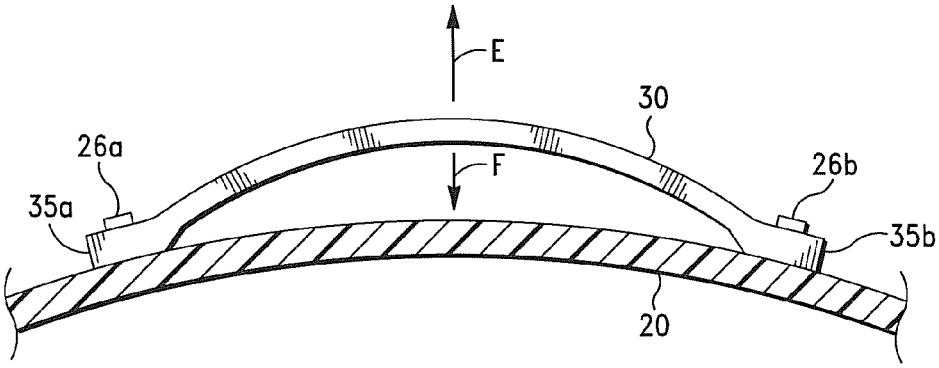
FIG. 7 is an illustration of a mouth guard retention apparatus of the invention showing the engagement (or recovery) force applied to a mouth guard secured thereby, in accordance with the invention.

Referring now to FIG. 7, there is shown an illustration of retention apparatus 30 secured to a helmet 20 on both ends 35*a*, 35*b*, and stretched in a direction denoted by arrow E, whereby the apparatus 30 applies an engagement or recovery force in the direction of arrow F, which would be applied to a mouth guard that is positioned between the apparatus 30 and helmet 20.

In a preferred embodiment of the invention, the retention apparatus of the invention provide an engagement force having a controlled force distribution, i.e. force profile, across the length of the apparatus (or member), with the maximum force, $F_m$, being disposed proximate the center of the apparatus.

Figure 8:
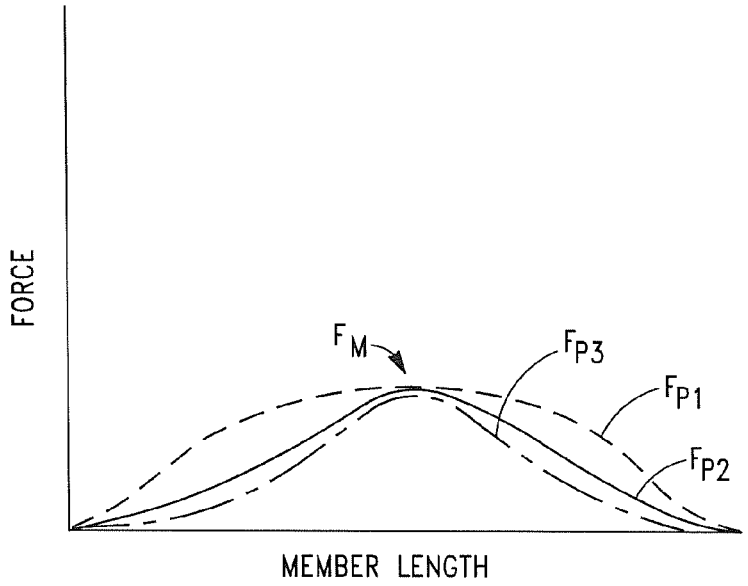
FIG. 8 is a graphical illustration of exemplar mouth guard retention apparatus force profiles, in accordance with the invention.

Referring now to FIG. 8, there are shown exemplar predetermined engagement force profiles, i.e. $F_{P1}$, $F_{P2}$, $F_{P3}$, that can be provided via the retention apparatus of the invention. As illustrated in FIG. 8 (and stated above), the maximum engagement force, $F_m$, is disposed proximate the mid-point of the apparatus length.

According to the invention, various means can be employed to provide the controlled force distribution, i.e. force profile, across the length of the apparatus (or member) and maximum engagement force, $F_m$.

In some embodiments of the invention, the controlled engagement force is provided as a function of the material employed to construct the retention apparatus, i.e. modulus of elasticity, and the cross sectional area of the retention apparatus.

In some embodiments of the invention, the controlled engagement force is provided solely as a function of the cross sectional area of the retention apparatus. By way of example, referring back to FIG. 6, in some embodiments, the retention apparatus ends 35*a*, 35*b* have a greater thickness than the central region 35*c* of the apparatus 30. According to the invention, the noted embodiment would provide a controlled, variable force profile to a mouth guard (when secured thereby) that is similar to force profile $F_{P1}$ shown in FIG. 8, i.e. the maximum force applied to the mouth guard being proximate the center of the retention apparatus.

Figure 9:
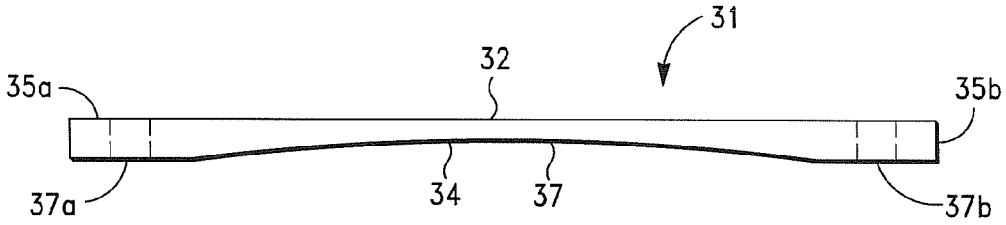
FIG. 9 is a side plan view of another embodiment of a mouth guard retention apparatus, in accordance with the invention.

Referring now to FIG. 9, there is shown another embodiment of a retention apparatus 31, wherein the bottom surface 34 of the retention apparatus 31 has a curvilinear shape. According to the invention, retention apparatus 31 would provide a controlled variable force profile to a mouth guard (when secured thereby), that is similar to force profile $F_{P2}$ shown in FIG. 8.

Figure 10:
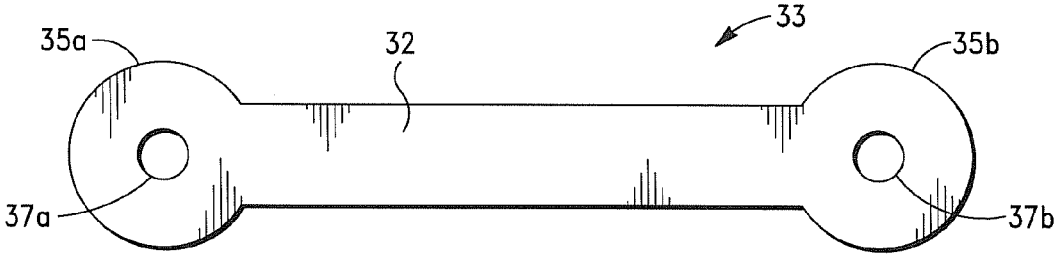
FIG. 10 is a top plan view of another embodiment of a mouth guard retention apparatus, in accordance with the invention.
Figure 11:
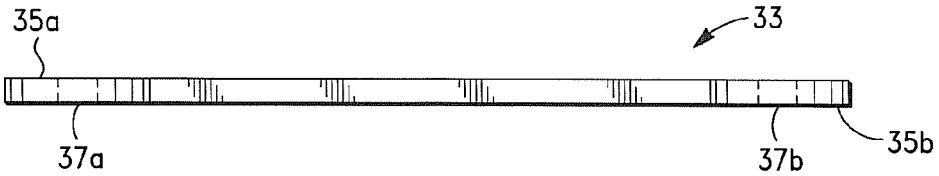
FIG. 11 is a side plan view of the mouth guard retention apparatus shown in FIG. 10, in accordance with the invention.

Referring now to FIGS. 10 and 11, in some embodiments, the width across the top surface 32 of the retention apparatus 33 is greater proximate the ends 35*a*, 35*b*. According to the invention, the ends 35*a*, 35*b* can thus comprises various configurations, such as rectangular or circular, as shown in FIG. 10.

In a preferred embodiment of the invention, the maximum engagement force, $F_m$, provided by the retention apparatus of the invention is less than approximately 1.0 lbs.

In some embodiments, the maximum engagement force, $F_m$, is preferably less than approximately 0.5 lbs. In some embodiments, the maximum engagement force, $F_m$, is preferably in the range of approximately 0.25-0.5 lbs.

Referring now to FIG. 12, there is shown one embodiment of a retention apparatus of the invention attached to a helmet 20. As illustrated in FIG. 20, the retention apparatus 30 is secured to the front of the helmet 20; preferably, above the facemask 22, via existing helmet screws 26*a*, 26*b* to temporarily secure a mouth guard 10 between the retention apparatus 30 and helmet 20.

Figure 14:
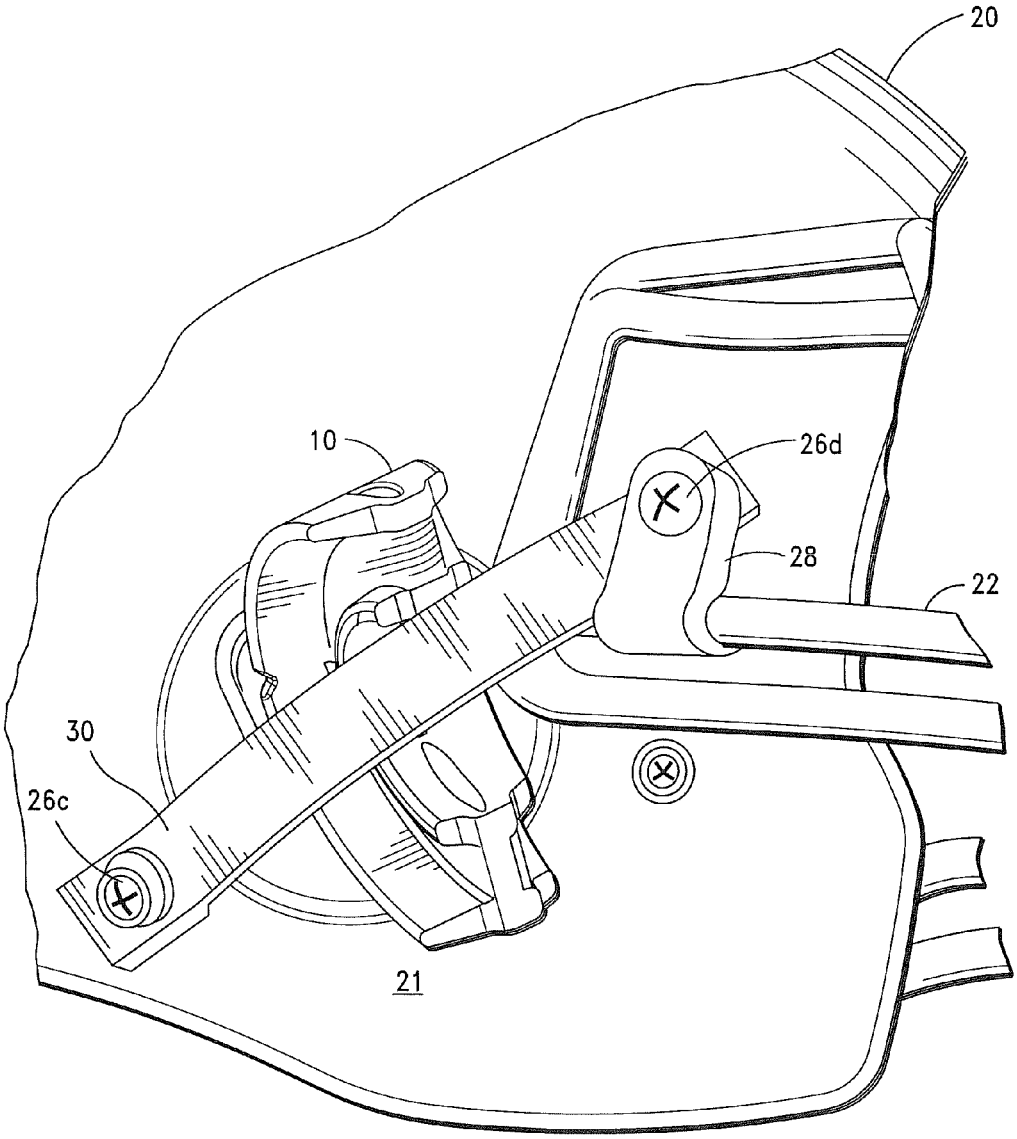

According to the invention, the retention apparatus 30 can also be secured proximate the side 21 of the helmet 20 via existing helmet screws 26*c*, 26*d*, as shown in FIGS. 13 and 14.

Figure 15:
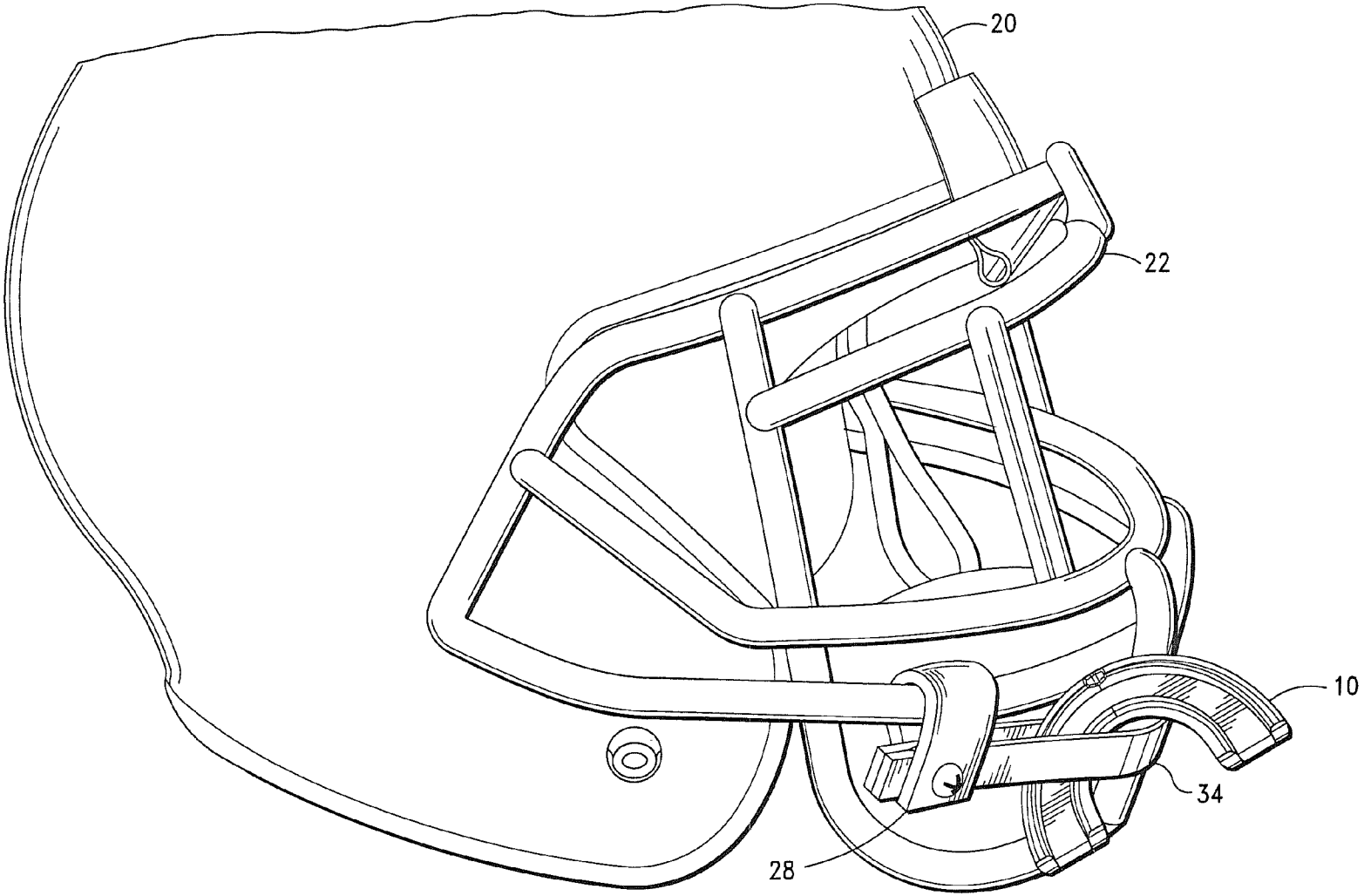
FIG. 15 is another front plan view of a football helmet with one embodiment of a mouth guard retention apparatus engaged on the lower facemask bars of the helmet, in accordance with the invention.

Referring now to FIG. 15, in some embodiments of the invention, the mouth guard retention apparatus 34 has an extended length that is sufficient to wrap around a bar 24 of the facemask 22 and directly engage a facemask retainer 28. In the noted embodiments, the mouth guard 30 can simply be placed within the looped apparatus 34.

With reference to FIGS. 12, 13 and 15, when an athlete temporarily removes a mouth guard from his/her mouth, e.g. during a huddle or on the side lines, the athlete can place the mouth guard in a secured mouth guard retention apparatus of the invention (whether positioned on the front or side of the helmet). Since mouth guards are generally U-shaped, by placing one end of the mouth guard in a mouth guard retention apparatus of the invention, as shown in FIGS. 12, 13 and 14, one end of the mouth guard will be easily accessible for removal and use.

As will readily be appreciated by one having ordinary skill in the art, the present invention provides numerous advantages compared to prior art methods and systems for temporarily holding mouth guards when not in use. Among the advantages are the following:

The provision of mouth guard retention means and associated methods for securing mouth guards to a variety of helmets that maintain the integrity of the mouth guards.

The provision of mouth guard retention means and associated methods that facilitate quick and easy placement, retention and removal of mouth guards.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A method for temporarily securing a mouth guard to a helmet, comprising the steps of:

providing a mouth guard retention apparatus, said mouth guard retention apparatus comprising a resilient elongated elastic retention member having a longitudinal axis and first and second ends, said elongated elastic retention member being configured to be attached to an exterior surface of a helmet proximate said first and second ends, wherein said elongated elastic retention member is configured to be disposed at a second position away from said helmet exterior surface, and wherein, when said elongated elastic retention member is attached to said helmet exterior surface proximate said first and second ends and in said second position said elongated elastic retention member provides a mouth guard retention space between said elongated elastic retention member and said helmet exterior surface, said elongated elastic retention member being further configured to apply an engagement force to a mouth guard approximately 0.5 lbs when said mouth guard is disposed in said mouth guard retention space, wherein said elongated elastic retention member securely retains said mouth guard against said helmet exterior surface during temporary periods of non-use without permanently deforming said mouth guard;

attaching said first and second ends of said resilient elongated elastic retention member to a first region on an exterior surface of a first helmet;

stretching said resilient elongated elastic retention member in said first direction a first distance away from said first helmet to provide a first mouth guard retention space between said elongated elastic retention member and said exterior surface of said first helmet;

positioning a first mouth guard within said first mouth guard retention space; and releasing said resilient elongated elastic retention member, wherein said resilient elongated elastic retention member applies said engagement force to said first mouth guard, and wherein said elongated elastic retention member securely retains said first mouth guard against said exterior surface of said first helmet during temporary periods of non-use without permanently deforming said first mouth guard.

* * * * *